US005644852A

United States Patent [19]

Fuller et al.

[11] Patent Number: 5,644,852

[45] Date of Patent: Jul. 8, 1997

[54] CHALK LINE REEL

[75] Inventors: Anthony B. Fuller, DeWitt; Toby J. Beckmann, Seward; Joseph A. Sorensen, South Bend; Thomas M. Chervenak, Beatrice, all of Nebr.

[73] Assignee: American Tool Companies, Inc., Lincoln, Nebr.

[21] Appl. No.: 611,065

[22] Filed: Mar. 5, 1996

[51] Int. Cl.[6] ..... B44D 3/38

[52] U.S. Cl. ..... 33/414; 33/393

[58] Field of Search ..... 33/413, 414, 756, 33/393, 394, 339

[56] References Cited

U.S. PATENT DOCUMENTS

| | | | |
|---|---|---|---|
| 665,119 | 1/1901 | Latter | 33/414 |
| 1,064,087 | 6/1913 | Prescott . | |
| 1,106,152 | 8/1914 | McIntosh | 33/414 |
| 1,219,473 | 3/1917 | Meldrum | 33/414 |
| 1,557,031 | 10/1925 | Conway | 33/414 |
| 1,567,976 | 12/1925 | Myers . | |
| 2,749,618 | 6/1956 | Landon | 33/414 |
| 3,438,595 | 4/1969 | Brown et al. . | |
| 3,691,639 | 9/1972 | Roeseler et al. . | |
| 3,888,010 | 6/1975 | Hyde et al. | 33/414 |
| 4,143,462 | 3/1979 | Gertz | 33/414 |
| 4,192,078 | 3/1980 | Lore et al. | 33/414 |
| 4,697,349 | 10/1987 | Lee | 33/393 |
| 5,042,159 | 8/1991 | Millen | 33/414 |
| 5,444,919 | 8/1995 | Alves | 33/339 |

*Primary Examiner*—Thomas B. Will
*Attorney, Agent, or Firm*—Brinks Hofer Gilson & Lione

[57] ABSTRACT

A chalk line reel includes an opening in the housing that permits access to a powdered chalk storage area. A movable door is mounted on the housing, and the door is movable to a closed position in which the door obstructs the opening. A first element on the door releasably couples the chalk line clip to the door, and a second element on the housing releasably couples the chalk line clip to the housing. The first and second elements are positioned such that clip resists movement of the door away from the closed position when the clip is coupled to the first and second elements.

11 Claims, 4 Drawing Sheets

CHALK LINE REEL

BACKGROUND OF THE INVENTION

This invention relates to an improvement to a chalk line reel of the type having a housing, a spool rotatably mounted in housing, a chalk line wound on the spool, and a clip secured to a free end of the chalk line.

Chalk line reels of this general type are well-known to the art, as shown for example in U.S. Pat. Nos. 3,888,010 and 3,438,595. Such chalk line reels typically use a finely powdered chalk which is applied to the chalk line as it is drawn from the housing. Typically, powdered chalk can be introduced into the housing via an opening in the housing, and a moveable door is mounted on the housing to close the opening.

Powdered chalk is designed to be highly visible, and is therefore often colored brightly. If the door in the housing were to be moved inadvertently so as to open the opening, powdered chalk could be spilled over the adjacent area. Such spilling of powdered chalk can represent a substantial problem, and the present invention is directed to a solution to that problem. Also, the chalk line typically terminates in a clip, and the line or clip that may get tangled or caught when the chalk line reel is stored with other tools.

SUMMARY OF THE INVENTION

According to this invention, a chalk line reel of the type described initially above is provided with a first element on the door configured to releasably couple the clip to the door and a second element on the housing configured to releasably couple the clip to the housing. The first and second elements are positioned such that when the door is in the closed position and the clip is coupled to the first and second elements, the clip resists movement of the door away from the closed position. In this way, accidental opening of the door and associated chalk spilling can be substantially reduced.

DETAILED DESCRIPTION OF THE PRESENTLY PREFERRED EMBODIMENTS

Figure 1:
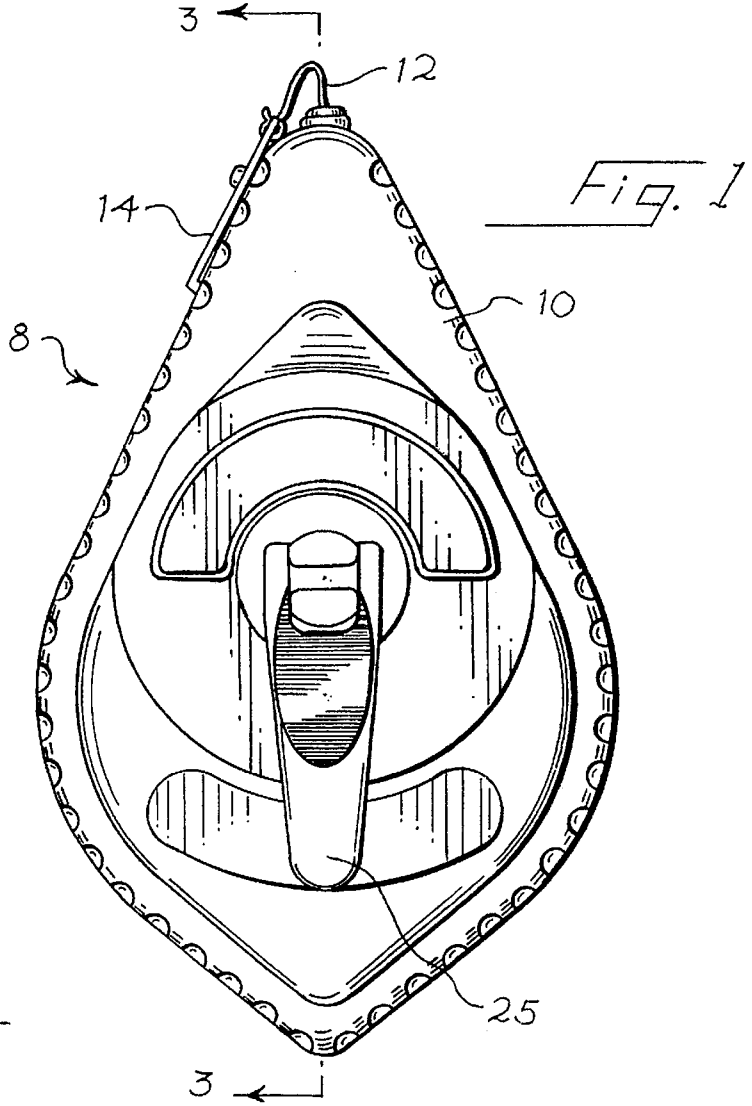
FIG. 1 is a front elevational view of a chalk line reel which incorporates a presently preferred embodiment of this invention.
Figure 2:
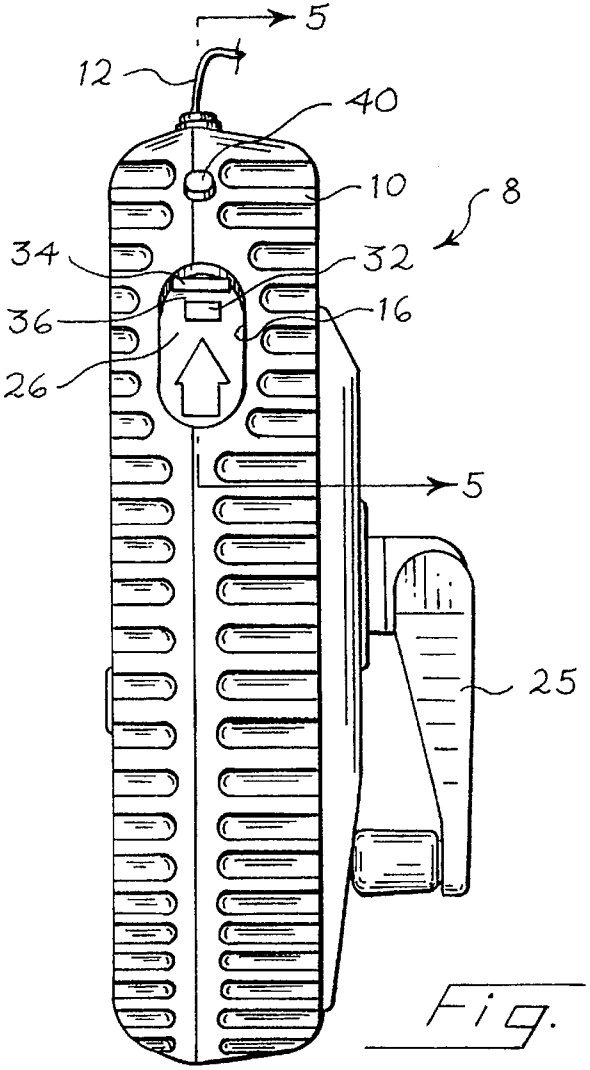
FIG. 2 is a side view of the chalk line reel of FIG. 1, in which the clip has been removed from the door for clarity of illustration.
Figure 3:
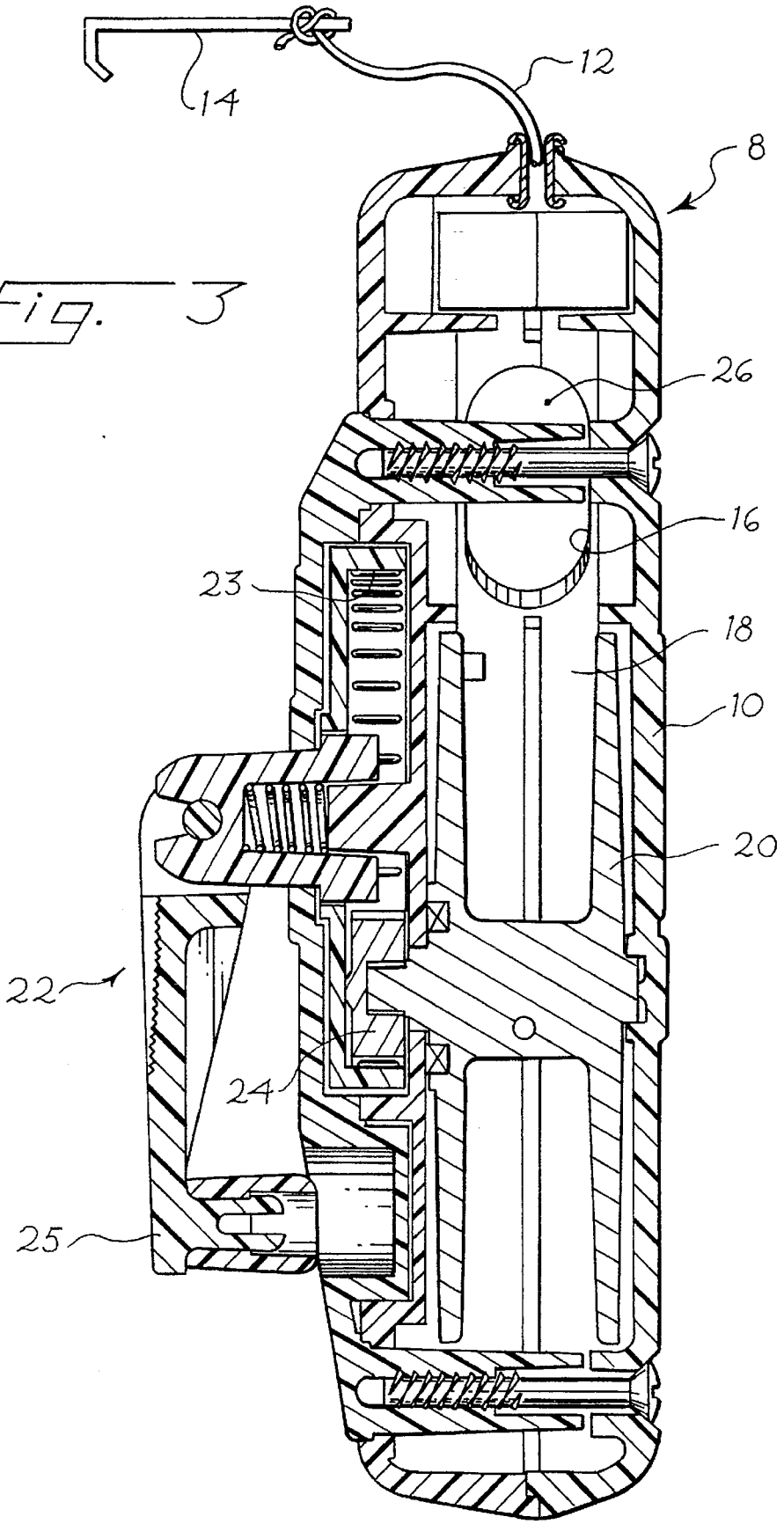
FIG. 3 is a cross-sectional view taken along line 3—3 of FIG. 1.

Turning now to the drawings, FIGS. 1 through 3 show overall views of a chalk line reel 8 which includes a number of conventional elements. In particular, the chalk line reel 8 includes a housing 10 which stores and releases a chalk line 12. The free end of the chalk line 12 is secured to a clip 14. The housing 10 includes an opening 16 that provides access to a powdered chalk storage area 18 within the housing 10. A spool 20 is rotatably mounted within the housing 10, and the spool 20 lets out and takes up the chalk line 12. A wind up mechanism 22 is coupled to the spool 20. The illustrated mechanism 22 includes gears 23, 24 and a crank 25.

In the most general sense, each of the features described above is conventional and has been shown merely to define the environment of this invention. All of these elements can be varied within broad limits, depending on the application. Above-referenced U.S. Pat. No. 3,438,595 provides one example of a suitable arrangement that can be employed.

Figure 5:
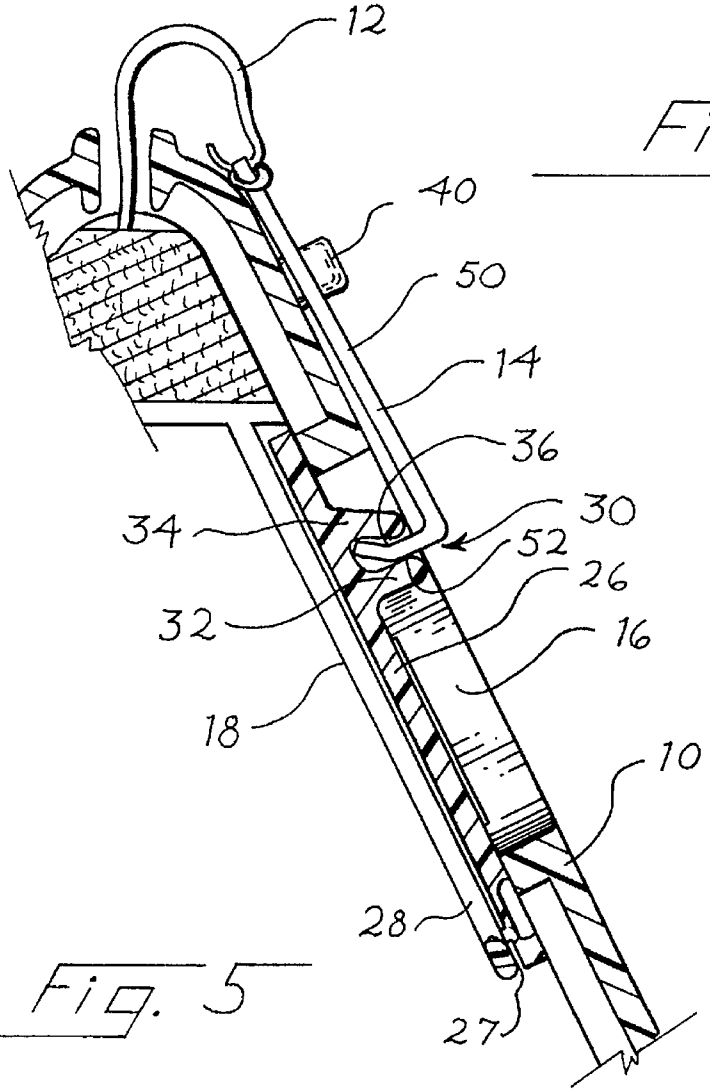
FIG. 5 is a partial sectional view taken along line 5—5 of FIG. 2.

According to this invention, the chalk line reel 8 includes a sliding door 26 which, as shown in FIG. 5, is guided in linear movement by guide rails 28. The door 26 is moveable between a closed position, (shown in FIG. 5) and an open position (not shown), in which the door is moved along the guide rails 28 to allow access via the opening 16 to the powdered chalk storage area 18. The door 26 preferably has a detent mechanism 27 between the door 26 and the housing 10 to retain it in the closed position shown in FIG. 5.

Figure 4:
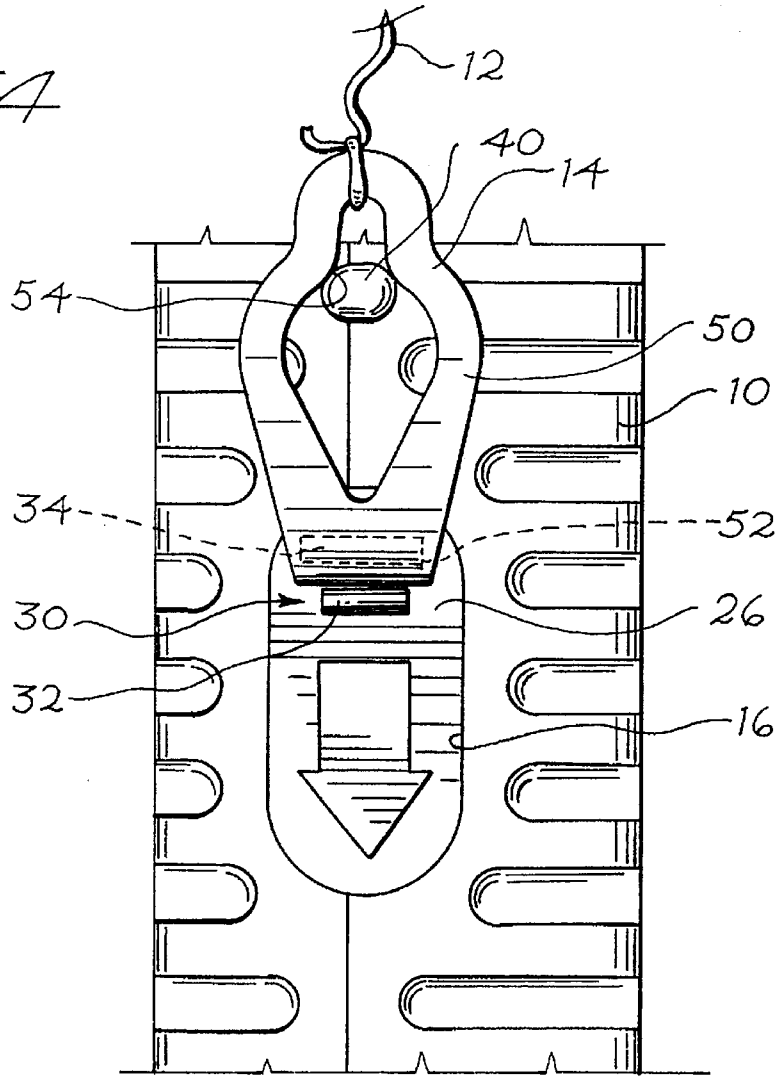
FIG. 4 is an enlarged side view of the chalk line reel of FIGS. 1–3, showing the clip installed in place on the door.

As best shown in FIGS. 4 and 5, the door 26 includes a first element 30 for releasably engaging the clip 14. In this embodiment the first element 30 includes two ribs 32, 34, which are upstanding from an exterior surface of the door 26, and which define a recess 36 therebetween.

As best shown in FIGS. 2, 4 and 5, the housing 10 defines a second element for releasably engaging the clip 14, which in this embodiment comprises an upstanding post 40. As best shown in FIGS. 4 and 5, the clip 14 includes a clip body 50 and a lip 52. The lip 52 extends out of the plane of the clip 50, and the clip 14 defines a J-shape in side view. As best shown in FIG. 4, the clip body 50 defines a post engaging surface 54, which in this embodiment is formed by an aperture in the clip body 50.

As best shown in FIGS. 4 and 5, the first and second elements 30, 40 are positioned such that when the door 26 is in the closed position shown in the drawings, and when the clip 14 is engaged with the first and second elements 30, 40, the clip 14 resists movement of the door 26 away from the closed position. In particular, when the lip 52 is pressed into the recess 36, the ribs 32, 34 releasably engage the lip 52 in a snap fit which tends to press the clip body 50 against the outer surface of the housing 10. As shown in FIG. 4 the snap fit described above holds clip body 50 against the housing 10, with the post 40 in engagement with the surface 54.

Once the clip 14 has been installed as shown in FIGS. 4 and 5, the door 26 is substantially prevented from opening (moving in the direction of the arrow of FIG. 4) until the clip 14 is removed from the post 40 and the recess 36.

The embodiment described above provides the important advantage that the door 26 can be substantially prevented from inadvertently opening. Additionally, the clip is releasably secured to the housing 10, thereby reducing the tendency for the clip 14 or the line 12 to become tangled or caught when the chalk line reel 18 is stored with other tools. These advantages are obtained at low cost, because the first and second elements 30, 40 are easily molded in place at substantially no increase in manufacturing cost.

Figure 6:
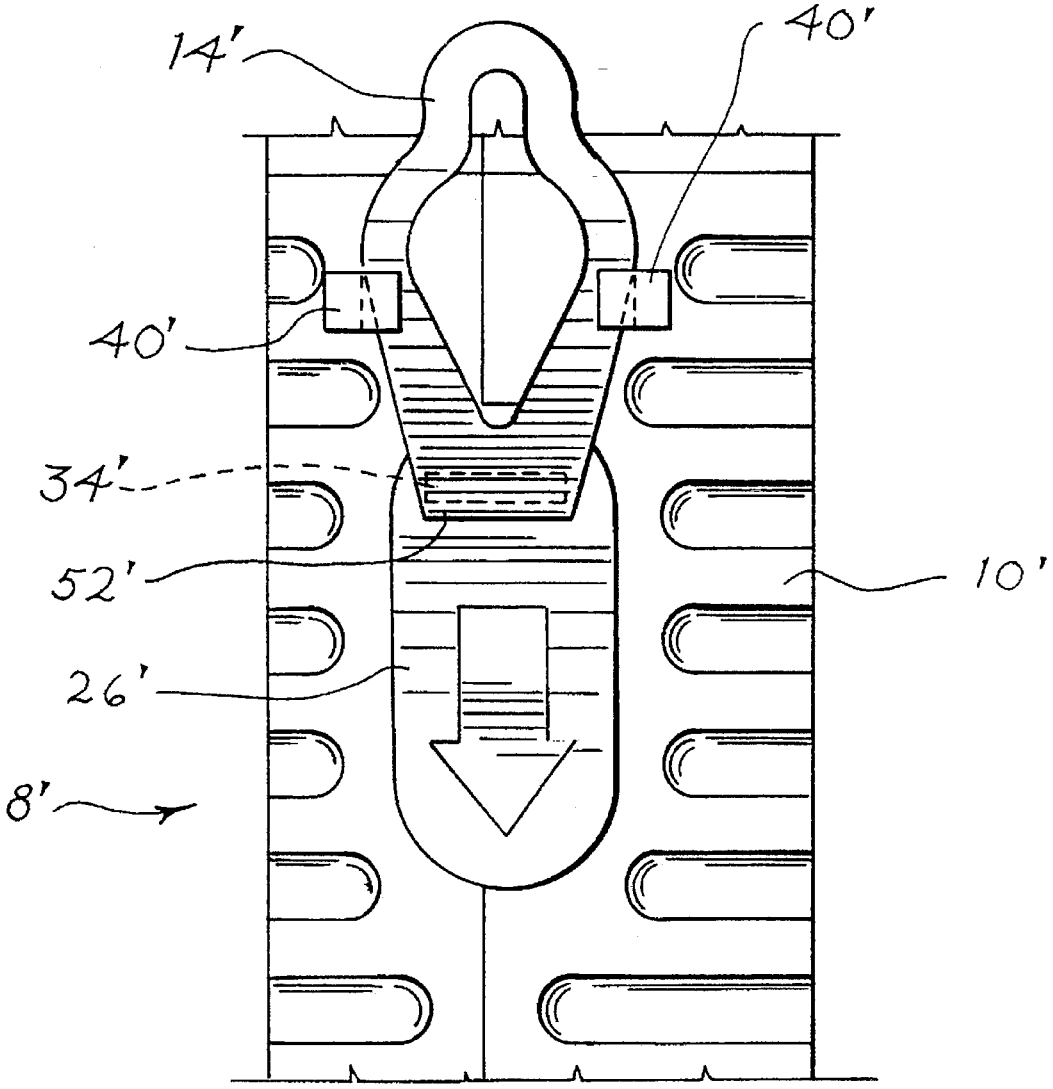
FIG. 6 is an enlarged side view corresponding to FIG. 4 of an alternative embodiment.

FIG. 6 shows portions of an alternative embodiment of a chalk line reel 8' that can be identical to the reel 8 discussed above, with the following exceptions. First, the housing 10' defines two protruding ribs 40', which are positioned to engage and retain the side edges of the clip 14, and the post 40 has been deleted. Second, the rib 32 has been deleted.

In this embodiment the clip 14' is moved between the ribs 40' in the direction opposite the arrow of FIG. 6 until the widest part of the clip 14' passes between the ribs 40', and the lip 52' engages the rib 34'. The ribs 40' hold the clip 14' in place, simultaneously holding the door 26' closed and storing the clip 14' on the housing 10'.

Of course, it should be understood that a wide range of changes and modifications can be made to the preferred embodiment described above. This invention can be adapted for use with doors that pivot rather than slide, and with clips of various shapes. For example, the post-engaging surface may be formed by a hook rather than an aperture in the clip. The first element on the door for engaging the clip can be formed with or without a recess, and with or without a snap fit. The second element can be formed as a post at either end of the door, and the second element can take other forms.

Materials, proportions, and dimensions can all be varied widely as appropriate for the specific application. In this embodiment the housing 10 and the door 26 are formed of a moldable thermoplastic material such as ABS, and the clip 14 is formed of a rigid metal such as 1018 steel, which can be nickel-plated if desired.

It is intended that the foregoing description be regarded as illustrative rather than limiting. It is the claims, including all equivalents, which are intended to define the scope of this invention.

We claim:

1. In a chalk line reel comprising a housing, a spool rotatably mounted in the housing, a chalk line wound on the spool, and a clip secured to a free end of the chalk line, the improvement comprising:

an opening in the housing;

a movable door mounted on the housing and movable to a closed position, in which the door obstructs the opening;

a first element on the door configured to releasably couple the clip to the door; and a second element on the housing configured to releasably couple the clip to the housing;

said first and second elements positioned such that the clip resists movement of the door away from the closed position when the clip is coupled to the first and second elements.

2. The invention of claim 1 wherein the clip comprises a body secured to the chalk line and a lip protruding from the body, and wherein the first element forms a recess that receives and retains the lip in a snap fit.

3. The invention of claim 2 wherein the lip and the body of the clip form a J-shape in side view.

4. The invention of claim 2 wherein the body of the clip forms a post-engaging surface, and wherein the second element comprises a post positioned to abut against the post-engaging surface.

5. The invention of claim 4 wherein the housing comprises guide rails that guide the door in movement toward and away from the closed position.

6. The invention of claim 1 wherein the opening provides access to a powdered chalk storage area within the housing.

7. The invention of claim 1 wherein the second element comprises a pair of ribs positioned to engage respective sides of the clip.

8. The invention of claim 7 wherein the clip forms a J-shape in side view.

9. In a chalk line reel comprising a housing, a spool rotatably mounted in the housing, a chalk line wound on the spool, and a clip secured to a free end of the chalk line, the improvement comprising:

an opening in the housing that provides access to a powdered chalk storage area within the housing;

a door;

guide rails that guide the door in movement toward and away from a closed position, wherein the door obstructs the opening when in the closed position;

a first element on the door, said first element forming a recess, said recess releasably receiving a lip included in the clip in a snap fit;

a second element on the housing adjacent to the opening, said second element comprising a post, said post releasably received in an aperture formed by the clip to limit movement of the clip with respect to the housing and thereby to resist movement of the door away from the closed position.

10. In a chalk line reel comprising a housing, a spool rotatably mounted in the housing, a chalk line wound on the spool, and a clip secured to a free end of the chalk line, the improvement comprising:

an opening in the housing that provides access to a powdered chalk storage area within the housing;

a door;

guide rails that guide the door in movement toward and away from a closed position, wherein the door obstructs the opening when in the closed position;

a first element on the door releasably engaging the clip;

a second element on the housing adjacent to the opening, said second element comprising a pair of ribs positioned to engage respective sides of the clip to limit movement of the clip with respect to the housing and thereby to resist movement of the door away from the closed position.

11. The invention of claim 10 wherein the clip forms a J-shape in side view.

* * * * *